US009897383B2

(12) United States Patent
Yesin et al.

(10) Patent No.: US 9,897,383 B2
(45) Date of Patent: Feb. 20, 2018

(54) HEAT EXCHANGER

(75) Inventors: Berk Yesin, Zurich (CH); Bruno Agostini, Dietikon (CH)

(73) Assignee: ABB Research Ltd., Zurich (CH)

( * ) Notice: Subject to any disclaimer, the term of this patent is extended or adjusted under 35 U.S.C. 154(b) by 1244 days.

(21) Appl. No.: 12/196,862

(22) Filed: Aug. 22, 2008

(65) Prior Publication Data

US 2009/0056916 A1 Mar. 5, 2009

(30) Foreign Application Priority Data

Aug. 27, 2007 (EP) ..... 07115054

(51) Int. Cl.

| | |
|---|---|
| ***F28F 7/00*** | (2006.01) |
| ***F28D 15/00*** | (2006.01) |
| ***F28D 1/053*** | (2006.01) |
| ***F28D 15/02*** | (2006.01) |
| ***F28F 1/12*** | (2006.01) |
| *F28D 21/00* | (2006.01) |
| *F28F 13/00* | (2006.01) |

(52) U.S. Cl.

CPC ..... *F28D 1/05383* (2013.01); *F28D 15/0233* (2013.01); *F28D 15/0266* (2013.01); *F28D 15/0275* (2013.01); *F28F 1/126* (2013.01); *F28D 2021/0029* (2013.01); *F28D 2021/0031* (2013.01); *F28F 2013/005* (2013.01); *Y10T 29/49364* (2015.01)

(58) Field of Classification Search

CPC ..... F28D 15/00; F28D 15/02; B23P 15/26
USPC ..... 165/80.2–80.4, 104.21, 153
See application file for complete search history.

(56) References Cited

U.S. PATENT DOCUMENTS

| | | | | |
|---|---|---|---|---|
| 4,998,580 | A * | 3/1991 | Guntly et al. | 165/133 |
| 5,713,413 | A | 2/1998 | Osakabe et al. | |
| 5,729,995 | A * | 3/1998 | Tajima | 62/259.2 |
| 6,005,772 | A | 12/1999 | Terao et al. | |
| 6,119,767 | A * | 9/2000 | Kadota et al. | 165/104.33 |
| 6,341,645 | B1 | 1/2002 | Tanaka et al. | |

(Continued)

FOREIGN PATENT DOCUMENTS

| | | | |
|---|---|---|---|
| EP | 0 409 179 | A1 | 1/1991 |
| EP | 409179 | A1 * | 1/1991 |

(Continued)

OTHER PUBLICATIONS

Translation of Japanese Document No. JP 2004020093 A named TRANS-JP2004020093.*

(Continued)

*Primary Examiner* — Len Tran
*Assistant Examiner* — Paul Alvare
(74) *Attorney, Agent, or Firm* — Taft Stettinius & Hollister LLP

(57) ABSTRACT

An exemplary heat exchanger is configured for removing heat energy from a heat generator. The heat exchanger including at least one conduit for a working fluid, which is arranged in an upright position of at least 45°, each conduit having an exterior wall and at least one interior wall for forming at least one evaporator channel and at least one condenser channel within the conduit. Furthermore, the heat exchanger includes a first heat transfer element for transferring heat into the evaporator channel and a second heat transfer element for transferring heat out of the condenser channel.

19 Claims, 8 Drawing Sheets

(56) References Cited

U.S. PATENT DOCUMENTS

| | | | | |
|---|---|---|---|---|
| 6,575,230 | B1 * | 6/2003 | Kadota et al. | 165/104.33 |
| 6,874,567 | B2 * | 4/2005 | Ohara | 165/104.21 |
| 7,017,657 | B2 * | 3/2006 | Sugito et al. | 165/104.21 |
| 2007/0133175 | A1 * | 6/2007 | Wu | 361/704 |

FOREIGN PATENT DOCUMENTS

| | | | |
|---|---|---|---|
| EP | 1 860 523 | | 11/2007 |
| JP | 60-259861 | | 12/1985 |
| JP | 6-151665 | | 5/1994 |
| JP | 2003-338593 | | 11/2003 |
| JP | 2004-020093 | | 1/2004 |
| JP | 2004020093 | A * | 1/2004 |
| JP | 2005229102 | A * | 8/2005 |

OTHER PUBLICATIONS

European Patent Publication No. EP0409179A1.*
Translation of Japanese Document JP 2005229102 A named Translation-JP 2005229102 A, translated Dec. 6, 2015.*
* European Search Report dated Feb. 15, 2008.
European Search Report issued in Application No. 08160875.4-2301 dated Jan. 5, 2009.

* cited by examiner

HEAT EXCHANGER

RELATED APPLICATION

This application claims priority under 35 U.S.C. § 119 to European Patent Application No. 07115054.4 filed in Europe on Aug. 27, 2007, the entire content of which is hereby incorporated by reference in its entirety.

TECHNICAL FIELD

The present disclosure in general relates to a heat exchanger. For example, the present disclosure relates to a heat exchanger that can be used for power-electronics components.

BACKGROUND INFORMATION

Low voltage drive systems have a competitive market with many global players. This imposes a strict low cost condition to their design. In a typical system, power-electronics components such as discrete or integrated (i.e. module type) semiconductor devices, inductors, resistors, capacitors and copper bus-bars are assembled in close proximity. PCB panels and control electronics are also present in all designs. During operation, these components dissipate heat of varying quantities. In addition, these components are tolerant to temperatures of varying levels. The environmental conditions surrounding the drive system also varies in terms of air temperature, humidity, dust and chemical content. The thermal management and integration concept of a drive system has to consider all of these underlined factors in addition to the electrical performance of the system.

Semiconductor components and power resistors are commonly built with a plate-mount design to be bolted or pressed onto a flat surface that is kept at a suitably cold temperature. Fan-blown-air cooled aluminium heat sinks and pumped water cooled cold plates are typical examples of such heat exchange surfaces. Other components such as inductors, capacitors and PCB circuit elements are typically cooled by air-flow.

Typically, components such as the choke inductors, aluminium heat sinks and DC-link capacitors are allowed to protrude on one side of a drive system whereas the more delicate components are collected on the other side. The cooling air from the fan flows through the capacitors, heat sink and the choke which have temperature limitations in the reverse order (e.g. capacitors need to be kept colder than the choke). The delicate components can be further enclosed and cooled via an additional fan in the higher IP rated versions.

The degree of environmental protection that is offered by an electronic product is commonly expressed in terms of its "Ingress Protection (IP) Rating". Many drive products are offered in IP20 or IP21 as standard with IP54 or higher protection ratings offered as optional. With lower IP ratings it is possible to design for through-flow of outside air within the drive enclosure while still providing adequate protection. Air filters may be employed to reduce the particles in the air. Down-facing air-vents on the enclosure walls prevent vertical water droplets from entering. With higher IP ratings, however, separation of outside air from the inside air of the drive enclosure becomes essential. For the highest protection levels, a water-tight enclosure is necessary.

An air-to-air heat-exchanger is commonly employed in high IP rated enclosures in order to dissipate heat to the ambient while completely separating the cabinet internal and outside air volumes. Heat-pipes and thermoelectric cooling elements are also used in such devices.

EP 0 409 179 A1 shows a heat pipe for computers with a conduit, which comprises an exterior and interior wall, which separates the evaporator and condenser tube. The device is only intended for a horizontal position of the evaporator section and the heat producing element.

In US 2007/0133175 a heat dissipation device with a heat transfer element is shown. The heat transfer element is made in form of a base plate, which is in contact to the heat producing element and a heat pipe. The base plate comprises grooves for better contact of the heat pipes and mounting holes for mounting the plate to a substrate, on which the electronic element is mounted.

SUMMARY

Exemplary embodiments disclosed herein are directed to a heat exchanger that allows an efficient heat removal.

A heat exchanger for removing heat energy from a heat generator is disclosed, comprising: at least one conduit for a working fluid, which is arranged in an upright position of at least 45°, each conduit having: an exterior wall and at least one interior wall for forming at least one evaporator channel and at least one condenser channel within the conduit; the heat exchanger further comprising a first heat transfer element for transferring heat into the evaporator channel; and a second heat transfer element for transferring heat out of the condenser channel.

A method of producing a heat exchanger is disclosed for removing heat energy from a heat generator, comprising: providing at least one conduit for a working fluid, each having an exterior wall and at least one interior wall for forming at least one evaporator channel and at least one condenser channel within the at least one conduit; and connecting to the at least one conduit a first heat transfer element for transferring heat into the evaporator channel and a second heat transfer element for transferring heat out of the condenser channel.

In another aspect, a heat-exchange arrangement is disclosed, comprising: at least one conduit for a working fluid, each having an exterior wall and at least one interior wall for forming at least one evaporator channel and at least one condenser channel within the at least one conduit; a first heat transfer element connected to the at least one conduit for transferring heat into the evaporator channel; and a second heat transfer element connected to the at least one conduit for transferring heat out of the condenser channel.

BRIEF DESCRIPTION OF THE DRAWINGS

Exemplary embodiments of the present disclosure are depicted in the drawings and are detailed in the description which follows.

In the drawings.

In the figures, same reference numerals denote the same or similar parts.

DETAILED DESCRIPTION

Figure 1:
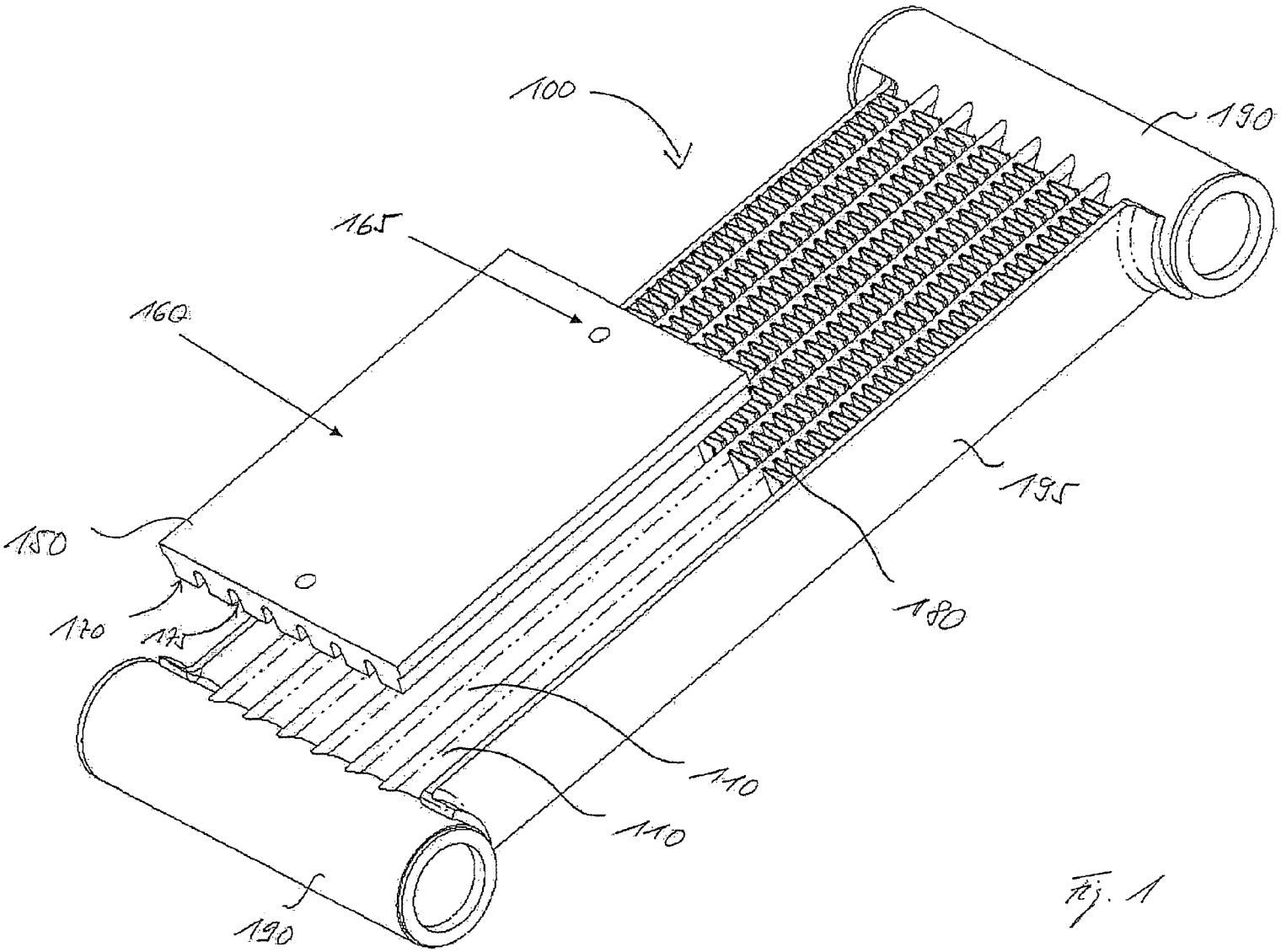
FIG. 1 illustrates a first exemplary embodiment of the present disclosure.

According to a first aspect the present disclosure provides a heat exchanger for removing heat energy from a heat generator, comprising at least one conduit for a working fluid, which is arranged in an upright position of at least 45°, each conduit having an exterior wall and at least one interior wall for forming at least one evaporator channel and at least one condenser channel within the conduit. Furthermore, the heat exchanger comprises a first heat transfer element for transferring heat into the evaporator channel and a second heat transfer element for transferring heat out of the condenser channel.

The present disclosure allows the use of a two-phase heat transfer principle in order to efficiently remove the input heat without the need for a pumping unit. This results in cost reduction and reliability improvement. The present disclosure provides a novel construction for a thermosyphon-type heat-exchanger that can be employed for cooling electric circuit components, e.g., for cooling low voltage AC drive systems. The present disclosure can be used as a loop-thermosyphon configuration by separating the upgoing and down-coming fluid streams in separate channels of multi-port conduit. Different numbers and sizes of channels can be used for the up-going and down-coming streams in order to optimize the boiling and condensation performance.

In an exemplary embodiment the first heat transfer element comprises a mounting element having a mounting surface for mounting the heat generator, and a contact surface for establishing a thermal contact to a portion of the exterior wall of the conduit associated with the evaporator channel.

In a further exemplary embodiment the at least one conduit is arranged in vertical position. The at least one evaporator channel and at least one condenser channel are aligned in parallel in the at least one conduit in another exemplary embodiment.

In a further exemplary embodiment the heat exchanger comprises a plurality of conduits. Furthermore, e.g., the second heat transfer element comprises cooling fins provided on a portion of the exterior wall of the conduit, e.g., only on a portion of the exterior wall of the conduit associated with the condenser channel.

In a further exemplary embodiment the heat exchanger comprises a distribution manifold, e.g., a header tube, which is connected to at least one end of at least one conduit.

Furthermore, e.g., the mounting element comprises a base plate having a planar mounting surface for mounting the heat generator and a contact surface opposite to the mounting surface comprising at least one groove conforming with a portion of the exterior wall of the conduit. Thus the heat exchanger is designed to efficiently discharge the heat generated by flat-plate mounted components for example to the ambient air while also allowing for the separation of the air volumes inside and outside the system enclosure. Thereby, e.g., the planar exterior sidewalls of the flat tube are oriented perpendicular to planar mounting surface of the base plate and that the mounting element comprises at least one mounting hole or at least one mounting slot on the mounting surface. Furthermore, e.g., the heat exchanger comprises two mounting elements, to allow for a compact design of the overall system.

In a further exemplary embodiment the conduit is flat tube having planar exterior sidewalls, e.g., a louvered fin-with-flat-tube design provides a high heat-transfer coefficient to air with small pressure drop in the air flow and in a compact size.

In a further exemplary embodiment the mounting element is made of aluminium or copper. Furthermore, the conduit can be made of aluminium. For example, brazed aluminium common in automotive industry can be used for reduced manufacturing cost, small size and good thermal-hydraulic performance. The present disclosure is suitable for automated manufacturing with heat-exchanger core assembly machines, commonly used in the automotive cooling industry. Such reuse of available series production equipment reduces the cost.

In a further exemplary embodiment the heat exchanger comprises a separation element for separating a first environment from a second environment, whereby the temperature of the first environment is higher than the temperature of the second environment.

According to a further aspect of the present disclosure a method of producing a heat exchanger is provided. Thereby, the method comprises the steps of providing at least one conduit for a working fluid, each having an exterior wall and at least one interior wall for forming at least one evaporator channel and at least one condenser channel within the at least one conduit, and connecting to the at least one conduit a mounting element, having a mounting surface for mounting the heat generator, and a contact surface for establishing a thermal contact to a portion of the exterior wall of the conduit associated with the evaporator channel.

In an exemplary embodiment of the inventive method components of the heat exchanger are joined together in a one-shot oven brazing process. Furthermore, the components of the heat exchanger can be covered with brazing alloy, e.g., an AlSi brazing alloy, before the brazing process. A flux material can be applied to the components of the heat exchanger before the brazing process, and that the brazing process is conducted in a non-oxidizing atmosphere.

In a further exemplary embodiment of the inventive method all components other than the mounting element are joined in a one-shot oven brazing process and the mounting element is pressed onto the exterior walls of the conduits with thermally conductive gap filling material in between.

A heat exchanger 100 according to a first exemplary embodiment of the present disclosure is described with reference to FIG. 1.

Figure 2:
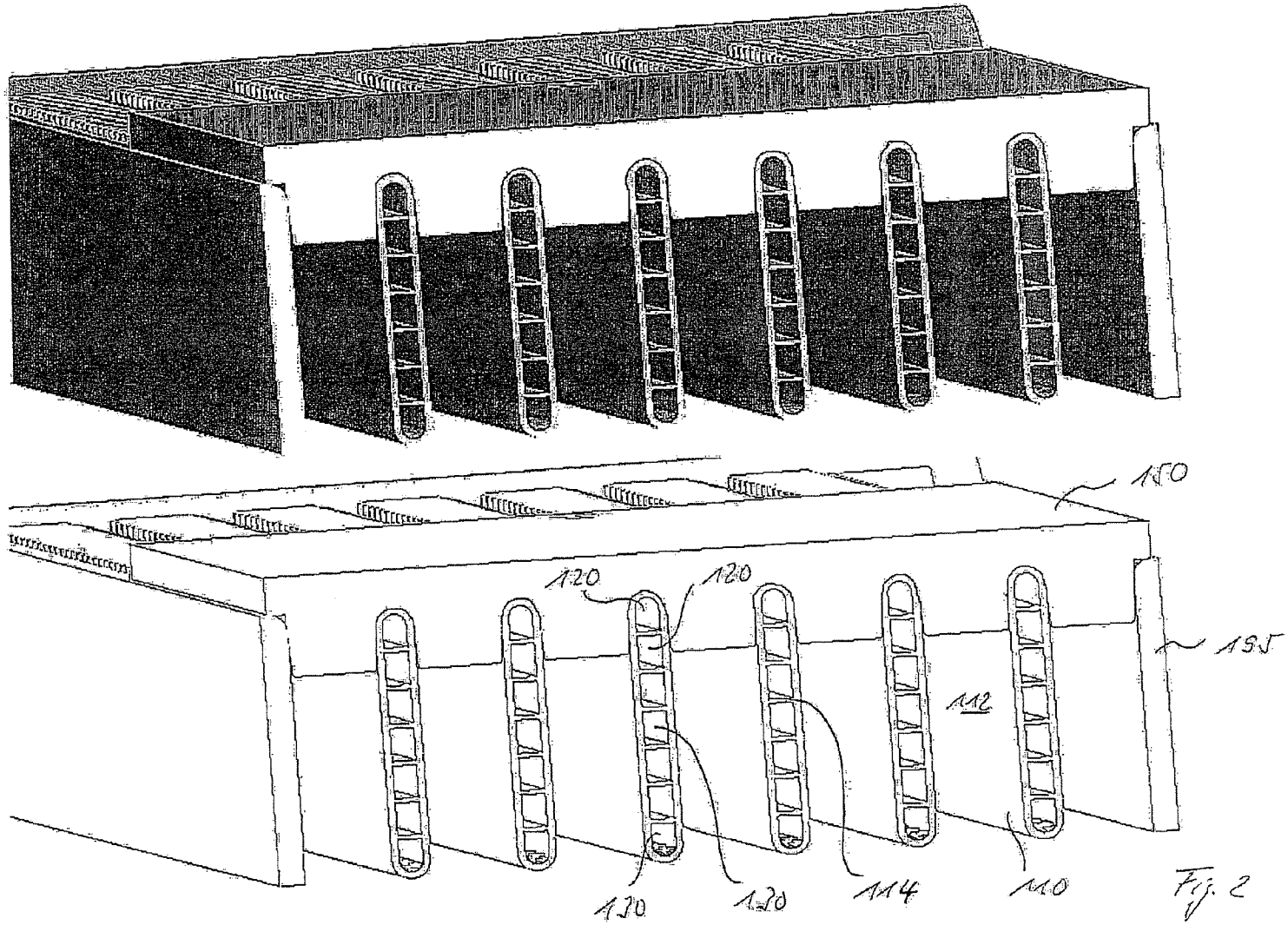
FIG. 2 is a cross-sectional view of the exemplary embodiment shown in FIG. 1.

As shown in FIG. 1 the heat exchanger 100 comprises a plurality of conduits 110 for a working fluid, each having an exterior wall 112 and each having interior walls 114 (see FIG. 2) for forming at least one evaporator channel 120 and at least one condenser channel 130 within the conduit 110. Furthermore, the heat exchanger comprises a first heat transfer element 150 for transferring heat into the evaporator channel and a second heat transfer element 180 for transferring heat out of the condenser channel. The conduits 110 are arranged in a vertical position, but other positions of at least 45° are also possible. The evaporator channels 120 and the condenser channels 130 are aligned in parallel in the conduits 110.

In the exemplary embodiment shown in FIG. 1 the first heat transfer element comprises a mounting element 150 having a mounting surface 160 for mounting a heat generator, and a contact surface 170 for establishing a thermal contact to a portion of the exterior wall 112 of the conduit associated with the evaporator channel 120.

For example, in the exemplary embodiment shown in FIG. 1 the mounting element 150 takes the form of a base plate having a planar mounting surface 160 for mounting the heat generator and a contact surface 170 opposite to the mounting surface comprising grooves 175 conforming with the exterior walls 112 of the conduits 110. Furthermore, the second heat transfer element 180 comprises cooling fins provided on exterior walls 112 of the conduits 110 and two header tubes, used as distribution manifolds 190, are connected to each end of the conduits 110. In case of heat from the heat generator 200 the working fluid ascends within the evaporator channel to the upper distribution manifold 190 and from there to the condenser channels 130, where the fluid condenses and drops to the lower distribution manifolds 190.

In the exemplary embodiment shown in FIG. 1 the conduits 110 take the form of flat multi-port extruded aluminium tubes. Thereby, the planar exterior sidewalls of the flat tube 110 are oriented perpendicular to planar mounting surface 160 of the base plate 150. Two support bars 195 can also be attached at the side ends of the assembly. The side bars 195 add mechanical strength to the assembly and also enclose the side-most fins 180 in order to force the air-flow through them.

The mounting element comprises two mounting holes 165 for mounting a heat generating unit thereto. As an alternative to the mounting holes on the flat side of the base-plate 150, T-shaped slots on the flat surface 160 can be used with to attach the components with bolts and nuts. The slots can be included as part of an extrusion to eliminate secondary machining steps needed to make mounting holes. The T-shaped slots can be designed to coincide with the areas over the fin columns such that their disturbance of the heat flow in the base-plate is reduced.

The heat exchanger 100 shown in FIG. 1 works with the loop thermosyphon principle. The heat exchanger is charged with a working fluid. Any refrigerant fluid can be used; some examples are R134a, R245fa, R365mfc, R600a, carbon dioxide, methanol and ammonia. The device is mounted vertically or with a small angle from the vertical such that the fins 180 are situated higher than the base-plate 150. The amount of fluid inside can be adjusted such that the level of liquid is not below the level of the base-plate 150.

The grooves 175 of the base-plate 150 conduct the heat generated by the electrical components to the front side of the multi-port flat tubes 110. As can be seen from FIG. 2 only the sections of the flat tubes that are covered by the base-plate grooves 175, which are the evaporator channels 120, directly receive the heat. Some of the heat will may also be conducted through the walls of the flat tubes. The evaporator channels 120 are fully or partially filled with the working fluid, depending on the amount of initial charge. The fluid in the evaporator channels 120 evaporate due to the heat and the vapour rises up in the channel by buoyancy effect. Some amount of liquid is also entrained in the vapour stream and will be pushed up in the channels.

Above the level of the base-plate the flat tubes 110 have air-cooling fins 180 on both sides. These fins 180 are typically cooled by a convective air flow, commonly generated by a cooling fan or blower (not shown). It is also possible to use natural convection currents. In the case of natural convection, the system can be installed with an increased angle from the vertical. The mixture of vapour and liquid inside the evaporator channels 120 reaches the top side header tube 190 and the flows down the condenser channels 130. While going through the condenser channels 130, vapour condenses back into liquid since the channels 130 are cooled by the fins 180. The liquid condensate flows down to the bottom header tube 190 and flows back into the evaporator channels 120, closing the loop.

As with all thermosyphon-type devices, all air and other non-condensable gases inside can be evacuated (i.e. discharged) and the system is partially filled (i.e. charged) with a working fluid. For this reason discharging and charging valves (not shown) are included in the assembly. The free ends of the header-tubes are suitable locations for such valves. A single valve can also be utilized for both charging and discharging. Alternatively, the heat exchanger can be evacuated, charged and permanently sealed. In this case, a valve is not necessary.

In the exemplary embodiment shown in FIG. 1, the cooling fins 180 completely cover the sides of the flat tubes 110. As a result, the up-going vapour in the evaporator channels 120 will start condensing as soon as it is above the level of the base-plate 150. This may lead to a cross flow of up going vapour and down coming condensate liquid which may increase the pressure drop of the stream and hinder the operation of the heat exchanger.

Figure 3:
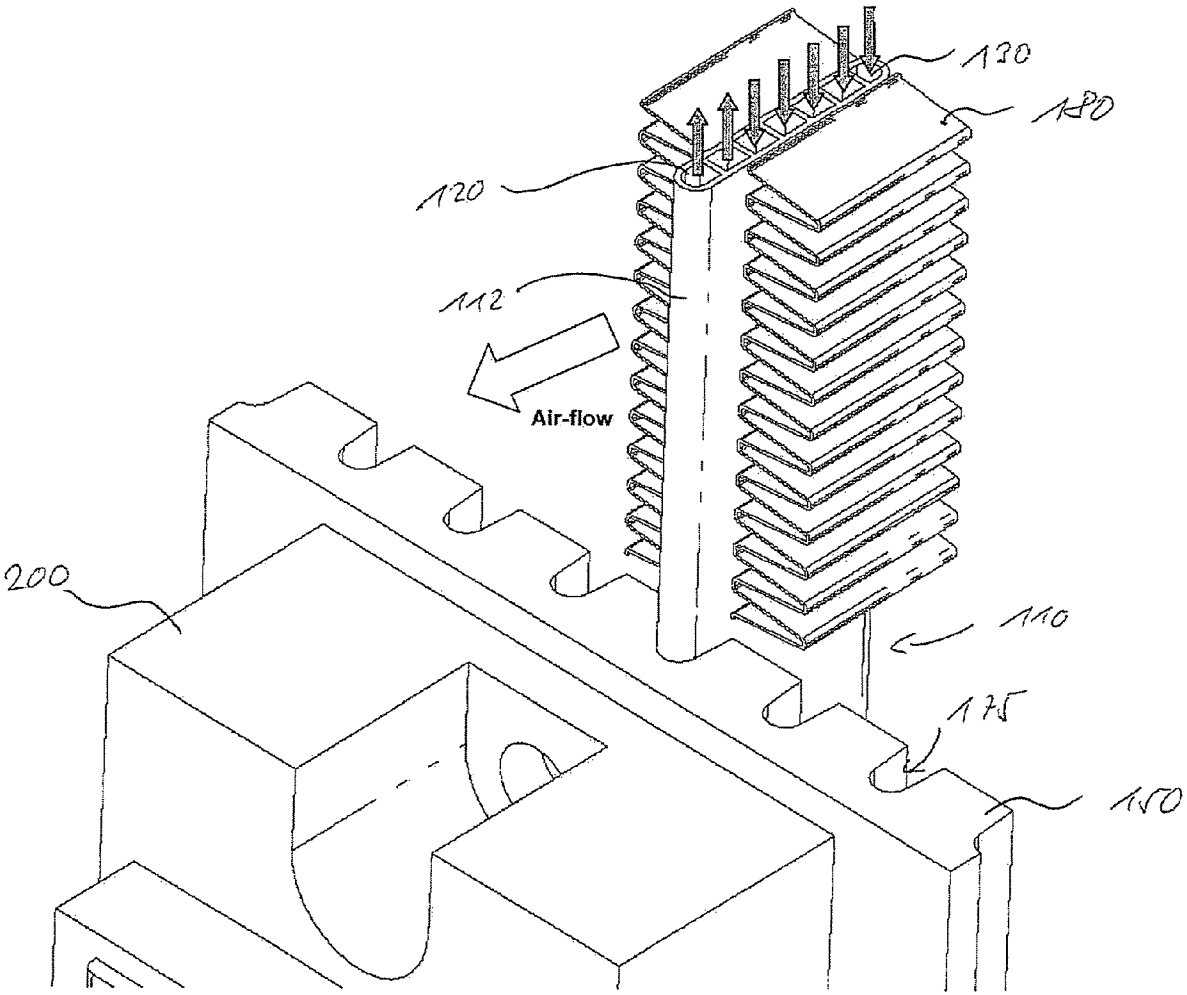
FIG. 3 shows detailed view of a second exemplary embodiment of the present disclosure.
Figure 4:
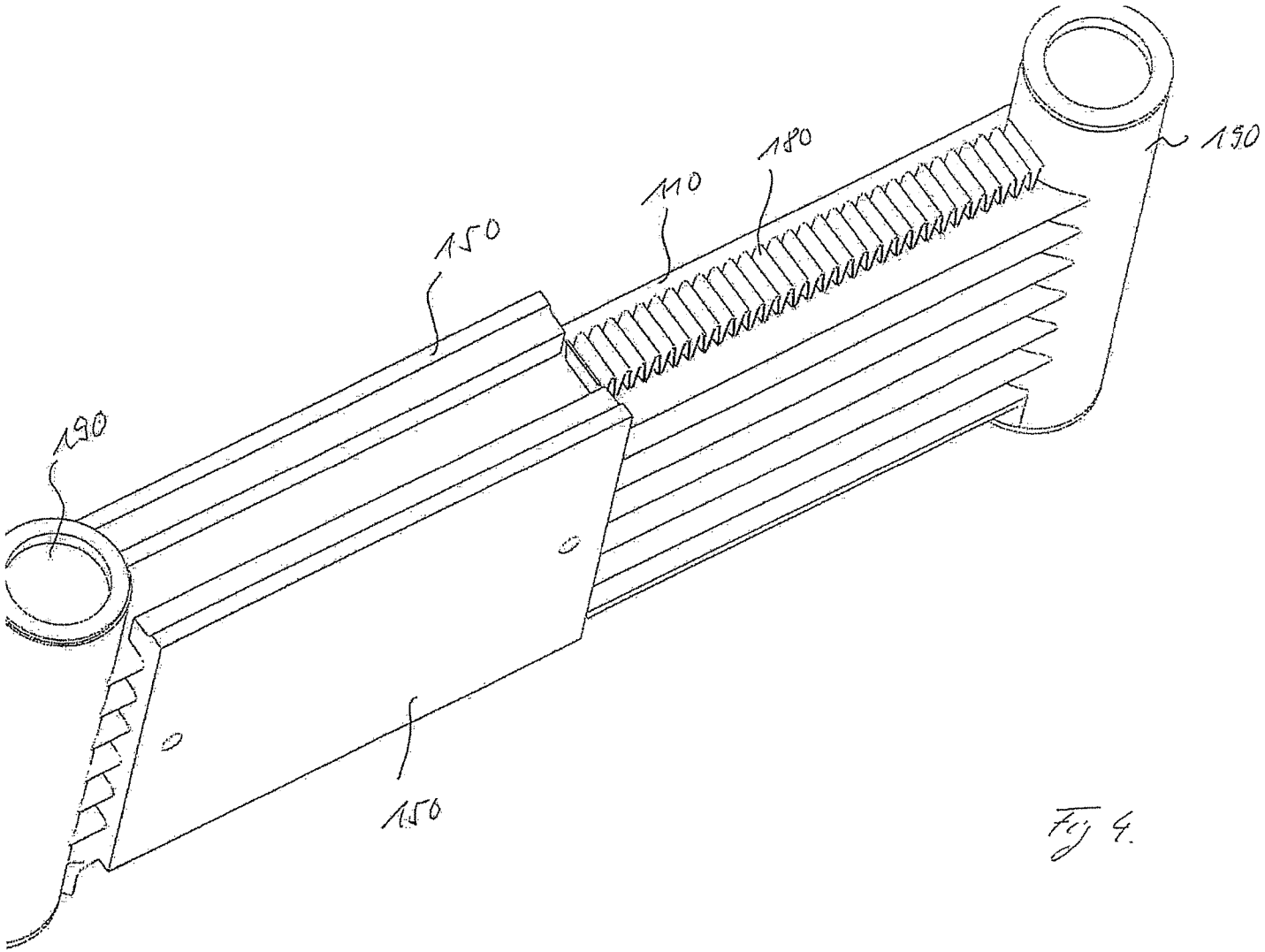
FIG. 4 shows further exemplary embodiment of the present disclosure.

To avoid this situation a further exemplary embodiment of the present disclosure is described with respect to FIG. 3. Thereby, the cooling fins 180 are provided only on a portion of the exterior wall 112 of the conduit 110 associated with the condenser channel 130. For the same reason, the cooling air can flow in the direction shown in FIG. 3 so that the coldest air stream hits the condenser channel side first.

The base-plate 150 can be made of a highly thermally conductive material such as aluminium or copper. It can be manufactured using extrusion, casting, machining or a combination of such common processes. The base-plate need not be made to the exact size of the flat-tube assembly. In fact, it may be preferred to make it larger in order to add thermal capacitance to the system. One side of the plate is contacting the flat tubes. The base-plate has grooves on this side that partially cover the multi-port flat tubes as shown in FIG. 3. The channels are shaped to conform to the flat-tubes. The other side of the plate is made flat to accept plate mounted heat-generating components 200 such as power electronics circuit elements (e.g. IGBT, IGCT, Diode, Power Resistors etc.). Mounting holes 165 with or without threads are placed on the flat surface to bolt down the components.

FIG. 3 shows a further exemplary embodiment of the present disclosure. In this variation of the basic design, two base-plates are assembled facing opposite directions. Each base-plate has grooves 165 that overlap evaporator channels 120 on both sides of the flat tubes. This configuration brings major benefits in the electric circuit layout as it minimized the inter-component distances. Similar to the configuration in FIG. 3, the cooling fins 180 are aligned to cover only the condenser sections.

It is noted that not both of the base-plates need to be designed to accept plate-mounted heat generating components as illustrated above. It is also possible that one of the plates is used only to as a block of mass, in order to increase the thermal capacitance of the system.

Figure 5:
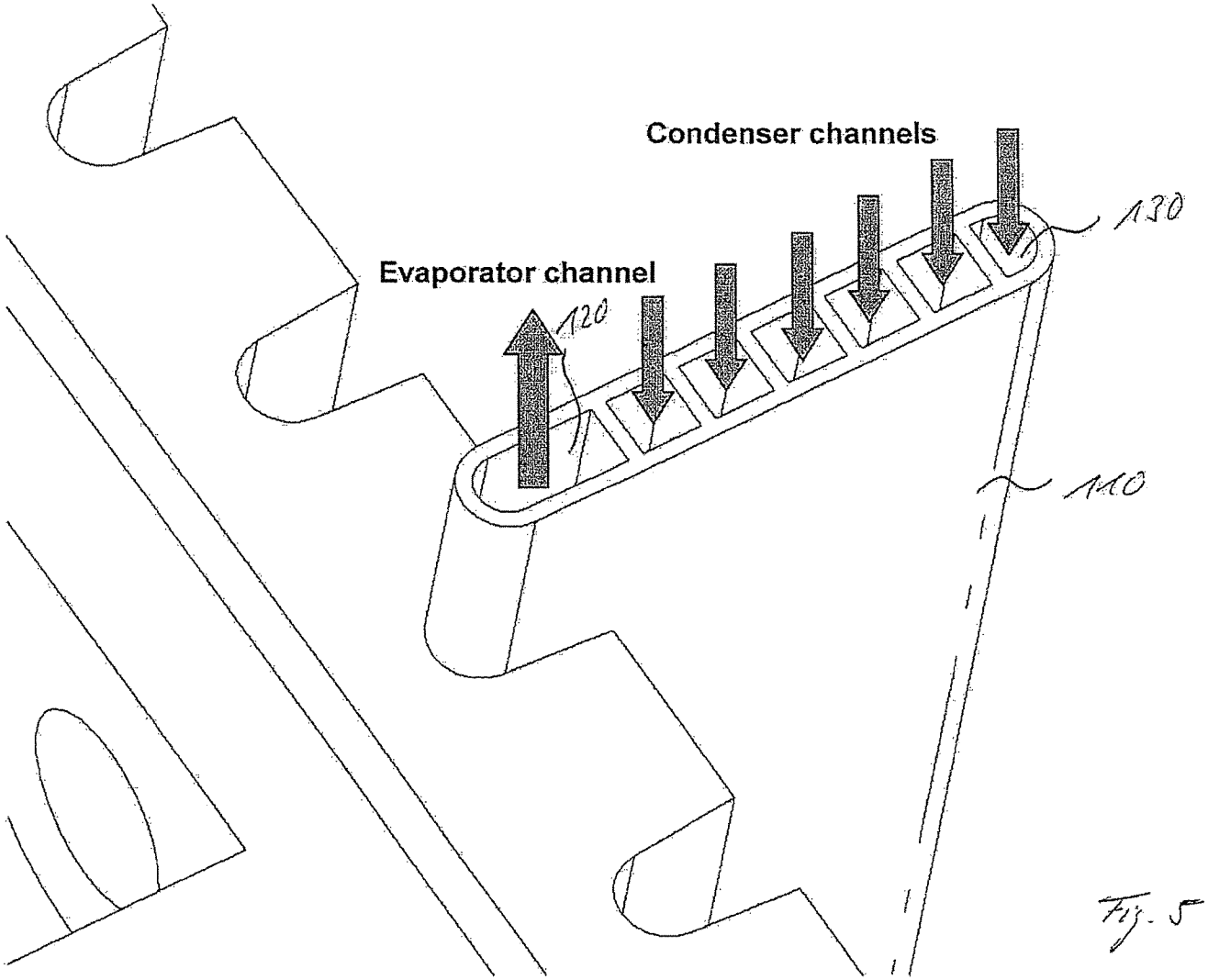
FIG. 5 shows further exemplary embodiment of the present disclosure.

The multi-port flat tubes shown in FIGS. 1 to 4 have a symmetric layout of the internal channels, whereby the up-going and down-coming streams in the loop thermosyphon configuration share the same multi-port tube. For this reason the channels can be configured for these two streams independently. For example, the largest pressure drop in the flow of the refrigerant vapour-liquid mixture is created inside the evaporator channels 120. For this reason larger channel cross-sectional area can be allocated to these channels as can be seen in FIG. 5.

Figure 6:
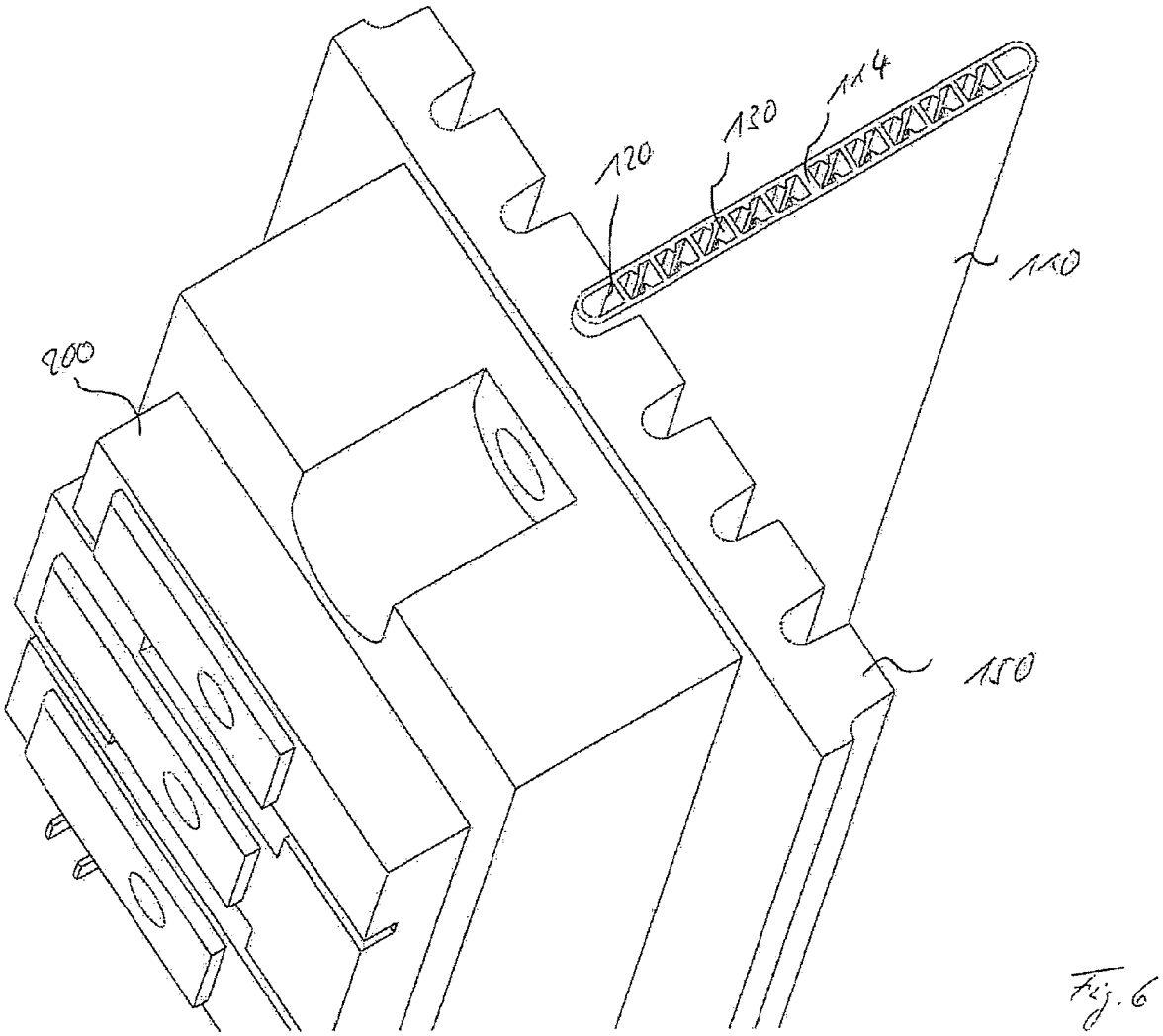
FIG. 6 shows further exemplary embodiment of the present disclosure.

For the condenser channels 130, smaller channels with dividing walls or additional fin-like features on the inner-wall surfaces can increase the inner channel surface thus increasing the heat-transfer surface, as can be seen in FIG. 6.

When using different size channels inside the multi-port tube it may be necessary also to have different wall thickness around the periphery of the tube so that all sections are equally strong against internal pressure. For example, the wall thickness around a larger sized evaporator channel can be increased while using a thinner wall thickness around the small condenser channels. In comparison to using a uniform and thick evaporator thickness, this approach can save on material costs. Typical wall thicknesses used in aluminium multi-port extruded flat tubes are in the order of 0.2 to 0.75 mm.

According to a further aspect of the present disclosure a method of producing a heat exchanger 100 is provided. Thereby, the method comprises the steps of providing at least one conduit 110 for a working fluid, each having an exterior wall 112 and at least one interior wall 114 for forming at least one evaporator channel 120 and at least one condenser channel 130 within the conduit 110, and connecting to the conduit 110 a mounting element 150, 183, having a mounting surface for mounting the heat generator, and a contact surface for establishing a thermal contact to a portion of the exterior wall of the conduit associated with the evaporator channel.

After the assembly, the heat-exchanger components can be joined together in a one-shot oven brazing process. Soldering and brazing of aluminium on to aluminium is particularly challenging because of the oxide layer on aluminium that prevents wetting with solder alloy. There are various methods employed to accomplish this task. The base aluminium material can be covered with an AlSi brazing alloy (also called the cladding) that melts at a lower temperature (around 590° C.) than the base aluminium alloy. The aluminium tubes are extruded with the cladding already attached as a thin layer. A flux material is also applied on the tubes, either by dipping the tubes into a bath or by spraying. When the parts are heated in the oven, the flux works to chemically remove the oxide layer of the aluminium. The controlled atmosphere contains negligible oxygen (nitrogen environment is commonly used) so that a new oxide layer is not formed during the process. Without the oxide layer, the melting brazing alloy is able to wet the adjacent parts and close the gaps between the assembled components. When the parts are cooled down, a reliable and gas-tight connection is established. Furthermore, the cooling fins and the tubes are also bonded to ensure a good thermal interface between them.

It is highly desirable that there is good thermal contact interface between the base-plate and the flat tubes. It would be ideal if the base-plate channels are also brazed onto the flat tubes during the oven brazing process. In fact, it is possible to use the base-plate as the holding fixture for the flat tube assembly while the assembly goes through the brazing oven. Assembling the whole device and brazing it at one shot would ensure that the channels on the base-plate are exactly matching the location of the flat tubes. Alternatively, a second, lower temperature soldering process can be employed to join the base-plate with the flat tubes after the heat-exchanger core is brazed. The lower temperature soldering is needed to make sure that the brazed joints do not come off during re-heating for soldering.

A potential disadvantage of a soldered or brazed connection can be the deformation (i.e. warping) of the flat surface of the base-plate. Refinement of the surface may require a post-brazing surface machining operation. Alternatively, the base-plate channels can be press-fit onto the flat tubes or a glue material with gap filling ability and high thermal conductivity can be used.

Furthermore, flat, multi-port tubes with louvered fins can be used. The flat tubes introduce less pressure drop to the air flow compared to round tubes. In addition, the multi-port design increases the internal heat-transfer surface. Louvered fins increase the heat-transfer coefficient without significant increase in pressure drop (louvers are twisted slits on the fin's surface). The fins are cut from a strip of sheet aluminium and bent into an accordion-like shape as shown. The pitch between the fins can be easily adjusted during assembly by "pulling on the accordion". Two round header tubes at the ends of the flat tubes constitute the distribution manifolds. Most importantly, the stacking and assembly of all these elements of the heat-exchanger core can be done in a fully automated way.

A heat exchanger 100 according to a further exemplary embodiment of the present disclosure is described with reference to FIG. 7.

Figure 7:
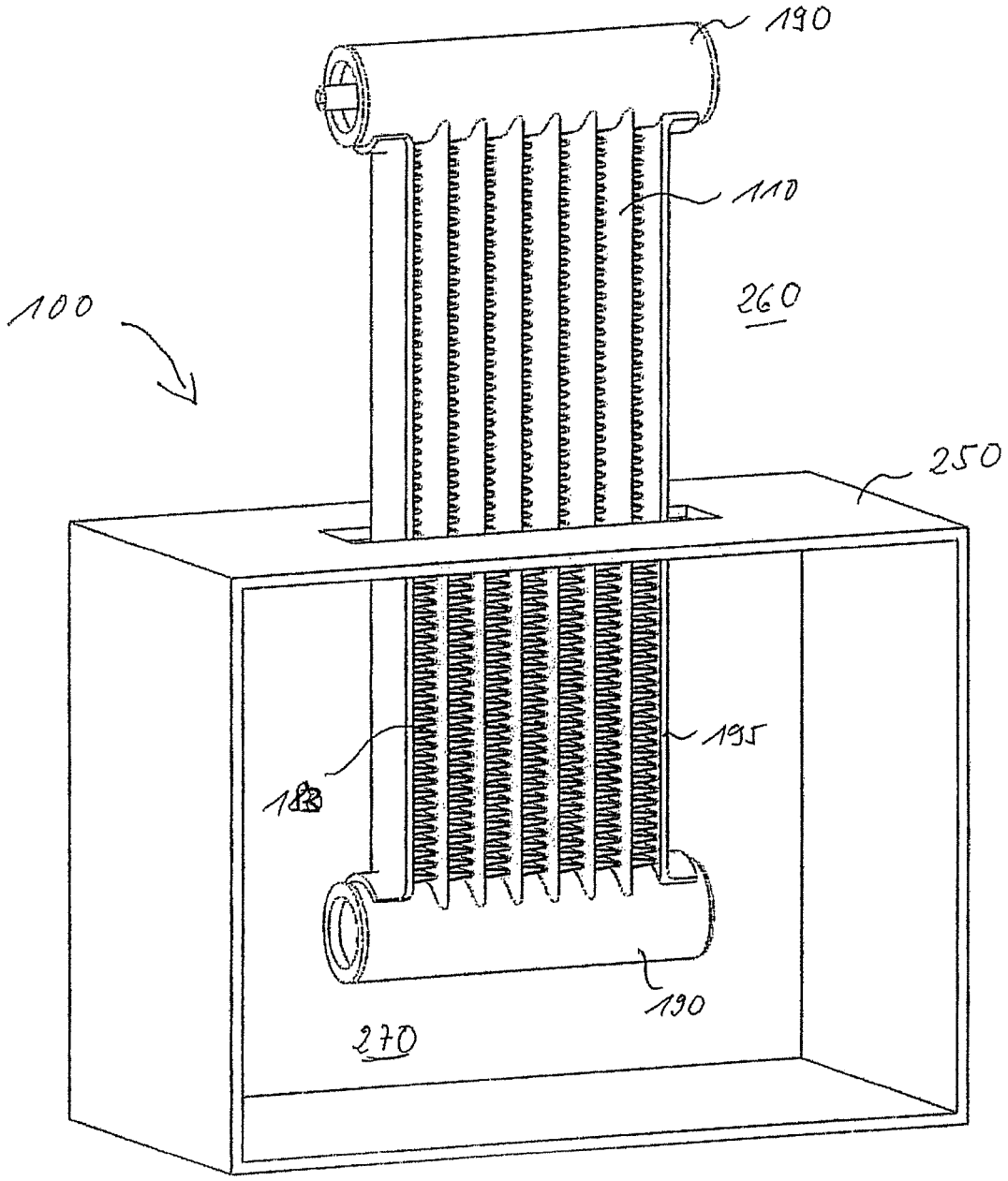
FIG. 7 shows further exemplary embodiment of the present disclosure.

As shown in FIG. 7 the heat exchanger 100 comprises a plurality of conduits 110 for a working fluid, each having an exterior wall 112 and each having interior walls 114 for forming at least one evaporator channel 120 and at least one condenser channel 130 within the conduit 110. Furthermore, the heat exchanger comprises a separation element 250 for separating a first environment 270 from a second environment 260, whereby the temperature of the first environment 270 is higher than the temperature of the second environment 260.

Figure 8:
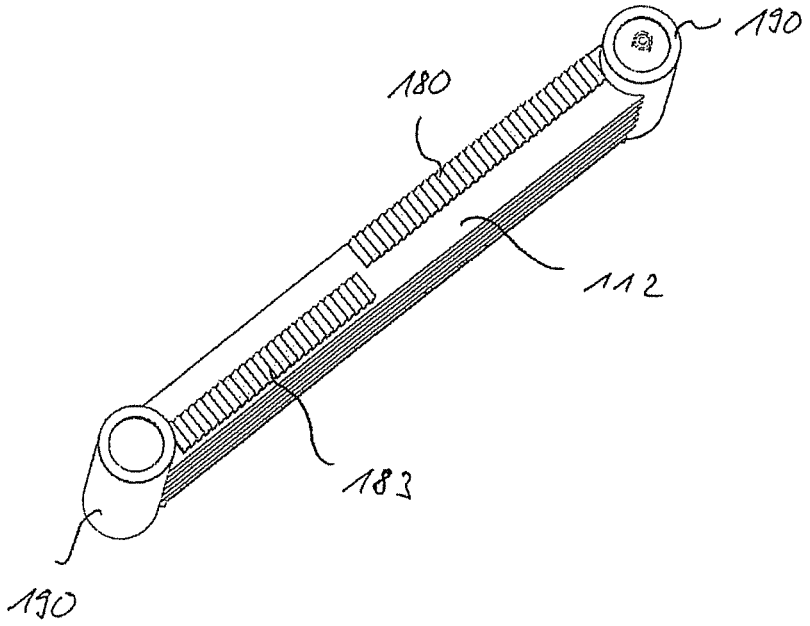
FIG. 8 is a cross-sectional view of the exemplary embodiment shown in FIG. 7.

As can be seen from FIG. 8 cooling fins 180 are provided on a portion of the exterior wall 112 of the conduit 110 associated with the condenser channel 130 and heating fins 183 are provided on a portion of the exterior wall 112 of the conduit 110 associated with the evaporator channel 120. The heating fins 183 and the cooling fins 180 work as first and second heat transfer elements, respectively.

The heat exchanger 100 shown in FIGS. 7 and 8 again works with the loop thermosyphon principle. The heat exchanger is charged with a working fluid. Any refrigerant fluid can be used; some examples are R134a, R245fa, R365mfc, R600a, carbon dioxide, methanol and ammonia.

The heating fins 183 conduct the heat from first environment 270 to the evaporator channels 120 of the heat exchanger 100. Some of the heat may also be conducted through the walls of the flat tubes. Then evaporator channels 120 are fully or partially filled with the working fluid, depending on the amount of initial charge. The fluid in the evaporator channels 120 evaporate due to the heat and the vapour rises up in the channel by buoyancy effect. Some amount of liquid is also entrained in the vapour stream and will be pushed up in the channels.

The mixture of vapour and liquid inside the evaporator channels 120 reaches the top side header tube 190 and flows down the condenser channels 130. While going through the condenser channels 130, vapour condenses back into liquid since the channels 130 are cooled by the fins 180 situated in second, cooler environment. The liquid condensate flows down to the bottom header tube 190 and flows back into the evaporator channels 120, closing the loop.

It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description all changes that come within the meaning and range and equivalence thereof are intended to be embraced therein.

LIST OF REFERENCE NUMERALS

100 Heat exchanger
110 conduit
112 Exterior wall of conduit
114 Interior wall of conduit
120 Evaporation channel
130 Condenser channel
150 First heat transfer element
160 Mounting surface
165 Mounting hole
170 Contact surface
175 Groove
180 Second heat transfer element
183 Heating fin
190 Distribution manifold
195 Support bar
200 Heat generator
250 Separation element
260 Second environment
270 First environment

What is claimed is:

1. A heat exchanger for removing heat energy from a heat generator, comprising:

a) a plurality of conduits for a working fluid arranged in an upright position of at least 45°, each conduit having:
  a1) an exterior wall and
  a2) at least one interior wall forming at least one evaporator channel and at least one condenser channel within the conduit, such that the at least one evaporator channel is structurally separated from the at least one condenser channel within the conduit by the at least one interior wall;

b) a first heat transfer element for transferring heat into the at least one evaporator channel; and c) a second heat transfer element for transferring heat out of the at least one condenser channel, the second heat transfer element being disposed only on a portion of the exterior wall, said portion of the exterior wall directly contacting the at least one condenser channel;

wherein the at least one condenser channel of each conduit extends from a first distribution manifold located on one end of the heat exchanger to a second distribution manifold located on an opposing end of the heat exchanger; and wherein the first heat transfer element is spaced apart from the portion of the exterior wall that directly contacts the at least one condenser channel; and the plurality of conduits are in fluid connection with one another at each end of the heat exchanger via the first and second distribution manifolds, wherein the at least one evaporator channel and at least one condenser channel are aligned in parallel in the plurality of conduits.

2. The heat exchanger according to claim 1, wherein the plurality of conduits are arranged in a vertical position.

3. The heat exchanger according to claim 1, wherein the first heat transfer element comprises a mounting element, having:

b1) a mounting surface for mounting the heat generator, and b2) a contact surface for establishing a thermal contact to a portion of the exterior wall of the conduit associated with the at least one evaporator channel.

4. The heat exchanger according to claim 3, wherein the mounting element comprises a base plate having a planar mounting surface for mounting the heat generator and a contact surface opposite to the mounting surface comprising at least one groove conforming with the portion of the exterior wall of the conduit associated with the at least one evaporator channel.

5. The heat exchanger according to claim 1, wherein each conduit is at least one of a flat tube having planar exterior sidewalls and is made of Aluminum.

6. The heat exchanger according to claim 1, wherein at least one of the evaporator channel has a larger cross-sectional area than the at least one condenser channel and the at least one condenser channel has more inner surface area than the at least one evaporator channel.

7. The heat exchanger according to claim 1, wherein the heat exchanger comprises a separation element for separating a first environment from a second environment, whereby the temperature of the first environment is higher than the temperature of the second environment.

8. The heat exchanger according to claim 1, wherein the first heat transfer element comprises heating fins provided on a portion of the exterior wall of the conduit associated with the at least one evaporator channel.

9. The heat exchanger according to claim 3, wherein the second heat transfer element comprises cooling fins provided on a portion of the exterior wall of the conduit associated with the at least one condenser channel.

10. The heat exchanger according to claim 2, wherein each conduit is at least one of a flat tube having planar exterior sidewalls and is made of Aluminum.

11. The heat exchanger according to claim 2, wherein the at least one of the evaporator channel has a larger cross-sectional area than the at least one condenser channel and the at least one condenser channel has more inner surface area than the at least one evaporator channel.

12. The heat exchanger according to claim 2, wherein the heat exchanger comprises a separation element for separating a first environment from a second environment, whereby the temperature of the first environment is higher than the temperature of the second environment.

13. The heat exchanger according to claim 2, wherein the first heat transfer element comprises heating fins provided on a portion of the exterior wall of the conduit associated with the at least one evaporator channel.

14. The heat exchanger according to claim 1, comprising:

wherein the first and the second distribution manifolds comprises a round header tube.

15. The heat exchanger according to claim 1, wherein the at least one evaporator channel is provided for guiding the working fluid towards an upper one of the distribution manifolds, and wherein the at least one condenser channel is provided for guiding the working fluid towards a lower one of the first and the second distribution manifolds.

16. The heat exchanger according to claim 1, wherein the conduits are arranged such that a stream of cooling air flowing through the heat exchanger contacts the at least one condenser channel prior to the at least one evaporator channel.

17. A heat-exchange arrangement comprising:

a plurality of conduits for a working fluid, each conduit having an exterior wall and at least one interior wall forming at least one evaporator channel and at least one condenser channel within the conduit, such that the at least one evaporator channel is structurally separated from the at least one condenser channel within the conduit by the at least one interior wall;

a first heat transfer element connected to each conduit for transferring heat into the at least one evaporator channel;

a second heat transfer element connected to the each conduit for transferring heat out of the at least one condenser channel, the second heat transfer element being disposed only on a portion of the exterior wall, said portion of the exterior wall directly contacting the at least one condenser channel;

wherein the at least one condenser channel of each conduit extends from a first distribution manifold located on one end of the heat exchanger to a second distribution manifold located on an opposing end of the heat exchanger; and wherein the first heat transfer element is spaced apart from the portion of the exterior wall that directly contacts the at least one condenser channel; and the plurality of conduits are in fluid connection with one another at each end of the heat exchanger via the first and second distribution manifolds, wherein the at least one evaporator channel and at least one condenser channel are aligned in parallel in the plurality of conduits.

18. The heat-exchange arrangement according to claim 17, wherein the arrangement removes heat energy from a heat generator.

19. The heat-exchange arrangement according to claim 17, comprising:

wherein the first and the second distribution manifolds comprises a round header tube.

* * * * *